US009551481B1

(12) United States Patent
Chen

(10) Patent No.: US 9,551,481 B1
(45) Date of Patent: Jan. 24, 2017

(54) SENSING LAMP

(71) Applicant: Chia-Teh Chen, Taipei (TW)

(72) Inventor: Chia-Teh Chen, Taipei (TW)

( * ) Notice: Subject to any disclaimer, the term of this patent is extended or adjusted under 35 U.S.C. 154(b) by 0 days.

(21) Appl. No.: 14/828,373

(22) Filed: Aug. 17, 2015

(51) Int. Cl.
*F21V 21/14* (2006.01)
*F21V 23/04* (2006.01)

(52) U.S. Cl.
CPC ..... *F21V 21/14* (2013.01); *F21V 23/0442* (2013.01); *F21V 23/0464* (2013.01); *F21V 23/0471* (2013.01); *F21V 23/0492* (2013.01)

(58) Field of Classification Search
CPC .. F21V 21/14; F21V 23/0442; F21V 23/0464; F21V 23/0471; F21V 23/0492
See application file for complete search history.

(56) References Cited

U.S. PATENT DOCUMENTS

2011/0284730 A1* 11/2011 Sturdevant ..... H05B 37/0218 250/252.1
2014/0268881 A1* 9/2014 Ku ..... F21V 23/0464 362/642

* cited by examiner

*Primary Examiner* — Mary Ellen Bowman
(74) *Attorney, Agent, or Firm* — Li & Cai Intellectual Property (USA) Office

(57) ABSTRACT

A sensing lamp comprises a light body and a sensing module. The light body has a light source. The sensing module connected to the light body comprises a sensing unit and a cover. The sensing unit has at least one sensor, a control circuit and at least one parameter adjusting element. The sensor and the parameter adjusting element are electrically coupled to the control circuit, and respectively provided to the front-side and the back-side of the sensing unit. The control circuit is disposed in the sensing unit. The sensing unit and the light body are rotatably connected. The sensor of the sensing unit is not covered by the cover when the sensing unit is rotated to a first angle. The parameter adjusting element is not covered by the cover when the sensing unit is rotated to a second angle, thus the user can manipulate the parameter adjusting element.

20 Claims, 11 Drawing Sheets

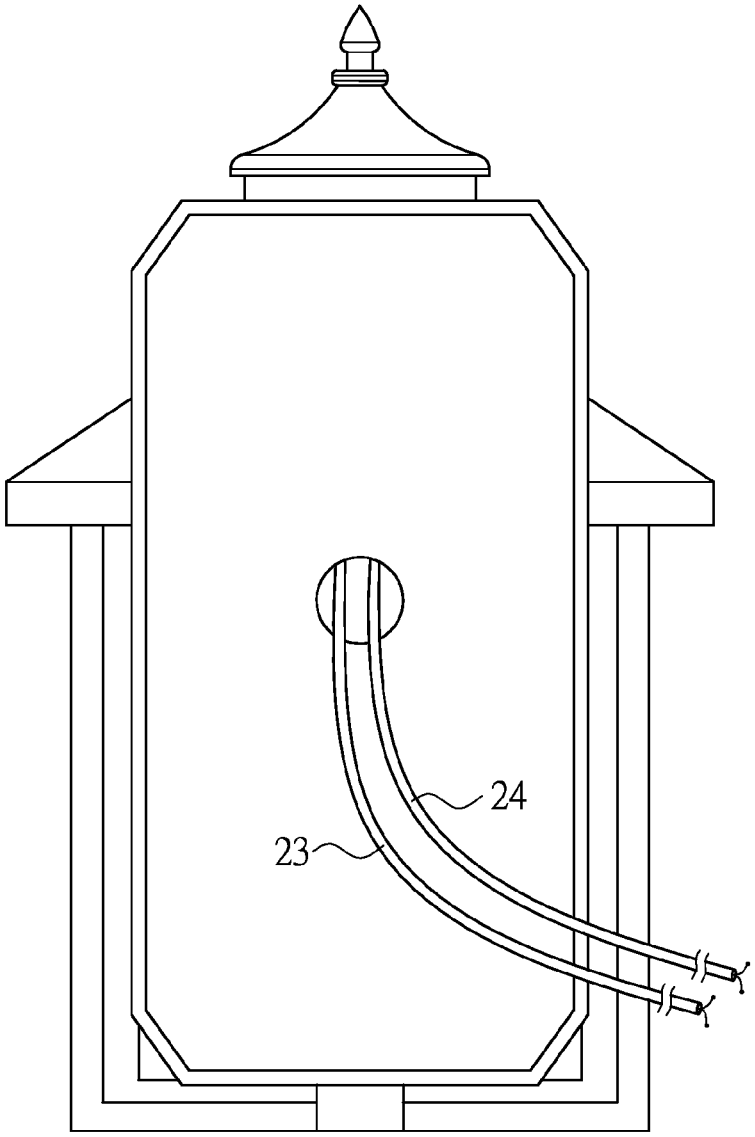
FIG.5
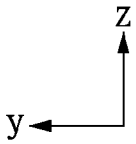

SENSING LAMP

BACKGROUND OF THE INVENTION

1. Field of the Invention

The present disclosure relates to lighting; in particular, to a sensing lamp.

2. Description of Related Art

A conventional wall lamp is illustrated in FIG. 1A. For considering the design of the structure's appearance, the conventional wall lamp 1 can be divided into a light body 11 and a back plate 12. The shape of the light body 11 is designed according to the requirement of the user. The back plate 12 is used for installing the wall lamp to a wall. Today, the lighting requirement for the user varies due to the user's presence; therefore the technology of sensing light has been developed. Utilizing a sensor for sensing the environment (environment light or the user activity), the sensing lamp can turn off the light source when the light is not required. For example, the wall lamp shown in FIG. 1A can be added with a sensor 111. The sensor 111 usually is a light sensor or a motion sensor. When the sensor 111 of the wall lamp senses that the environment light is not enough or the user is approaching, the sensor 111 can turn on the light.

Conventionally, the sensor and the control circuit of the wall lamp are individually arranged. As shown in FIG. 1A, the sensor 111 can be disposed on the top (or the bottom) of the light body 11. The designed position of the sensor 111 is for obtaining a more accurate sensing result or larger sensing range. Besides, the location of the sensor 111 shown in FIG. 1A may be designed to different positions. For example, referring to the conventional wall lamp 1' shown in FIG. 1B, the sensor 122 is disposed on the back plate 12', and the parameter adjusting element 121' is disposed at the bottom of the back plate 12'.

Referring to FIG. 1A again, the control circuit (not shown in FIG. 1A) connecting the sensor 111 is usually disposed in the back plate 12. In order to let the user easily adjust the related parameter of the sensor 111 such as the sensitivity, brightness or time of the light mode, or the start time of turning on the light, the parameter adjusting element(s) (for example, the switch or knob) is (are) exposed on the surface (for example, bottom surface or side surface) of the back plate 12. That is, the design of the back plate 12 has to fit in with the wiring and switching element (or adjusting element) of the control circuit, and the appearance design of the back plate 12 is so restricted accordingly. Taking FIG. 1A as an example, two parameter adjusting elements 121 are disposed at the bottom surface of the back plate 12. The user can manipulate the parameter adjusting elements to adjust the light mode or lighting parameters of the sensing wall lamp. In the same way, the parameter adjusting element 121' shown in FIG. 1B is disposed at the bottom of the back plate 12'. Because the parameter adjusting elements are usually located at the bottom of the back 12', it cannot accord with user-friendly adjustment, and the design flexibility of the back plate is limited. Please refer to FIG. 2 showing a block diagram of a conventional sensing wall lamp. The control circuit 13 receives exterior electrical power, and the control circuit 13 is electrically coupled to the light source 110 (disposed in the light body 11 shown in FIG. 1), the sensor 111 and the parameter adjusting element 121. However, referring to FIG. 3, based on the circumstance of arranging the sensor 111 and the corresponding circuit 13 separately and individually, a plurality of conducting wires (for example the two conducting wires 131 shown in FIG. 3) for connecting the sensor 111 and the control circuit 13 may be required, according to the complexity of the sensor 111 (or the types of the adjusted parameters of the wall lamp). Furthermore, the power wires of the light source 110 in the light body 11 and the control wires 133 of the parameter adjusting elements 121 lead to complicated wiring of the elements in the lamp. As such, the related cost of production of the lamp product and the probability of defects resulting during the production process would be increased.

SUMMARY OF THE INVENTION

The object of the present disclosure is to provide a sensing lamp, for sensing environment light or personnel activities to change its lighting mode.

In order to achieve the aforementioned objects, according to an embodiment of the present disclosure, a sensing lamp is provided. The sensing lamp comprises a light body and a sensing module. The light body has a light source. The sensing module connects the light body. The sensing module comprises a sensing unit and a cover. The sensing unit has at least one sensor, a control circuit and at least one parameter adjusting element. The sensor and the parameter adjusting element are electrically coupled to the control circuit. A first side of the sensing unit is provided with the sensor. A second side of the sensing unit is provided with the parameter adjusting element. The control circuit is disposed in the sensing unit. The cover partially covers the sensing unit. The sensing unit and the light body are rotatably connected. The sensing unit is capable of rotating to a first angle and a second angle. The sensor at the first side of the sensing unit is not covered by the cover when the sensing unit is rotated to the first angle. The parameter adjusting element at the second side of the sensing unit is not covered by the cover when the sensing unit is rotated to the second angle.

In one embodiment, the sensing unit is an infrared sensing unit.

In one embodiment, the sensor comprises at least one infrared sensing element and an infrared lens. The infrared sensing element is electrically coupled to the control circuit. The infrared lens is disposed in front of the infrared sensing element.

In one embodiment, the sensing unit is a microwave sensing unit.

In one embodiment, the sensing unit comprises at least one antenna. The antenna is electrically coupled to the control circuit.

In one embodiment, the sensing unit is a light sensing unit.

In one embodiment, the sensor comprises at least one light sensing element and a lens. The light sensing unit is electrically coupled to the control circuit. The lens is disposed in front of the light sensing element.

In one embodiment, the sensing lamp is a wall lamp, a road lamp, a chandelier or a ceiling lamp.

In one embodiment, when the sensing unit is rotated to the first angle, the sensor and the cover form an enclosed space to cover the control circuit and the parameter adjusting element.

In one embodiment, the cover has an opening portion. The sensor corresponds to the opening portion of the cover when the sensing unit is rotated to the first angle.

In one embodiment, the cover has an opening portion. The parameter adjusting element corresponds to the opening portion of the cover when the sensing unit is rotated to the second angle.

In one embodiment, the difference between the first angle and the second angle is less than 180 degrees.

In one embodiment, the difference between the first angle and the second angle is 180 degrees.

In one embodiment, the control circuit of the sensing unit is connected to an exterior electrical power source or a driving circuit.

In order to achieve the aforementioned objects, according to an embodiment of the present disclosure, a sensing lamp is provided. The sensing lamp comprises a light body, a back plate and a sensing module. The light body has a light source. The back plate connects the light body. The sensing module is disposed on the back plate. The sensing module comprises a sensing unit and a cover. The sensing unit has at least one sensor, a control circuit and at least one parameter adjusting element. The sensor and the parameter adjusting element are electrically coupled to the control circuit. A first side of the sensing unit is provided with the sensor. A second side of the sensing unit is provided with the parameter adjusting element. The control circuit is disposed in the sensing unit. The cover partially covers the sensing unit. The sensing unit and the back plate are rotatably connected. The sensing unit is capable of rotating to a first angle and a second angle. The sensor at the first side of the sensing unit is not covered by the cover when the sensing unit is rotated to the first angle. The parameter adjusting element at the second side of the sensing unit is not covered by the cover when the sensing unit is rotated to the second angle.

In one embodiment, the sensing unit is an infrared sensing unit.

In one embodiment, the sensing unit is a microwave sensing unit.

In one embodiment, the sensing unit is a light sensing unit.

In one embodiment, the cover has an opening portion. The sensor corresponds to the opening portion of the cover when the sensing unit is rotated to the first angle.

In one embodiment, the cover has an opening portion. The parameter adjusting element corresponds to the opening portion of the cover when the sensing unit is rotated to the second angle.

In summary, a sensing lamp is provided, in which the sensor and the control circuit are integrated into the sensing module. As such, the wiring layout is simple, the arrangement of control wires or power wires is simplified, and the related cost of production of the lamp product and the probability of defects resulting during production process can be reduced. The sensing lamp is provided with a user-friendly way for adjustment and a more concise and aesthetic appearance (the parameter adjusting element is concealed). By utilizing the rotatable sensing unit of the sensing lamp, the user can easily rotate the sensing unit to an angle (the second angle) adapted for operating the parameter adjusting element(s), so as to adjust the related parameter of the sensing unit. After the adjustment is finished, the sensing unit can return to the normal operation angle (the first angle). Because the back plate of the sensing lamp is not restricted to be incorporated with the parameter adjusting element(s), the design flexibility is significantly increased when considering matching the back plate to the aesthetic appearance of the overall light body.

In order to further the understanding regarding the present disclosure, the following embodiments are provided along with illustrations to facilitate the disclosure of the present disclosure.

BRIEF DESCRIPTION OF THE DRAWINGS

FIG. 5 shows a back view drawing of a sensing lamp according to an embodiment of the present disclosure;

DETAILED DESCRIPTION OF THE PREFERRED EMBODIMENTS

The aforementioned illustrations and following detailed descriptions are exemplary for the purpose of further explaining the scope of the present disclosure. Other objectives and advantages related to the present disclosure will be illustrated in the subsequent descriptions and appended drawings.

An Embodiment of the Sensing Lamp

Figure 4:
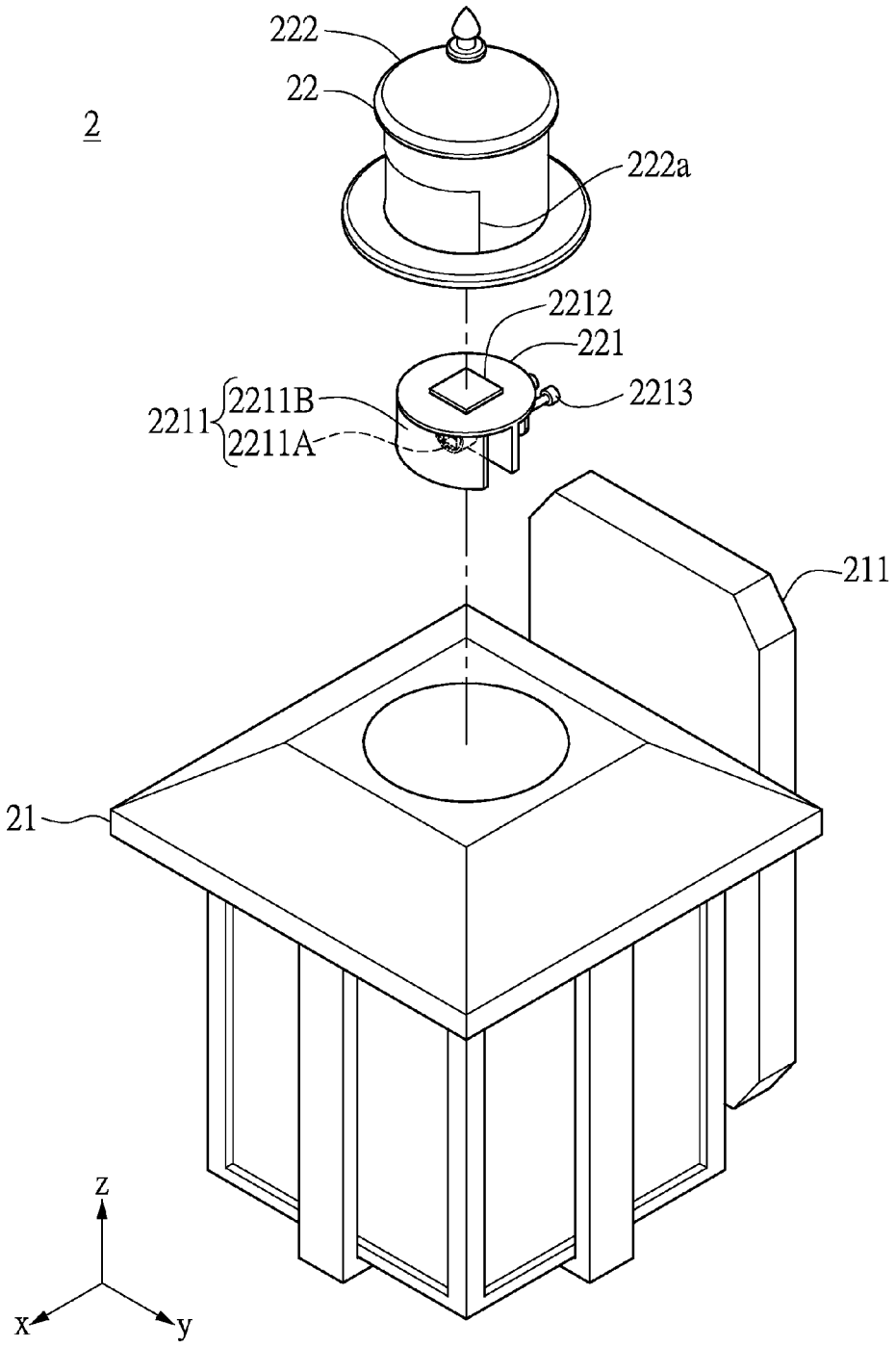
FIG. 4 shows an exploded view drawing of a sensing lamp according to an embodiment of the present disclosure.

Please refer to FIG. 4 showing an exploded view drawing of a sensing lamp according to an embodiment of the present disclosure. The sensing lamp 2 comprises a light body 21 and a sensing module 22. The light body 21 has a light source. The light source is usually disposed in the light body 21, and the light source is not shown in FIG. 4. An artisan of ordinary skill in the art will appreciate the design manner of the light source. The light source can be an LED light source, an incandescent light source or a fluorescent light source, but the present disclosure is not so restricted. In this embodiment, the sensing lamp 2 is a wall lamp, but the present disclosure is not so restricted. The light body 21 has a back plate 211 for connecting to the wall. In general, the power wires of the sensing lamp 2 are connected to the light source and the related circuit of the sensing module 22 through the back plate 211. The back plate 211 of the sensing lamp 2 in this embodiment does not include any exposed parameter adjusting element. This embodiment integrates the sensing module 22 with the control circuit and cooperates with the design of built-in parameter adjusting element of the sensing module 22, for simplifying the assembling of the wires and elements of the sensing lamp 2.

Figure 1A:
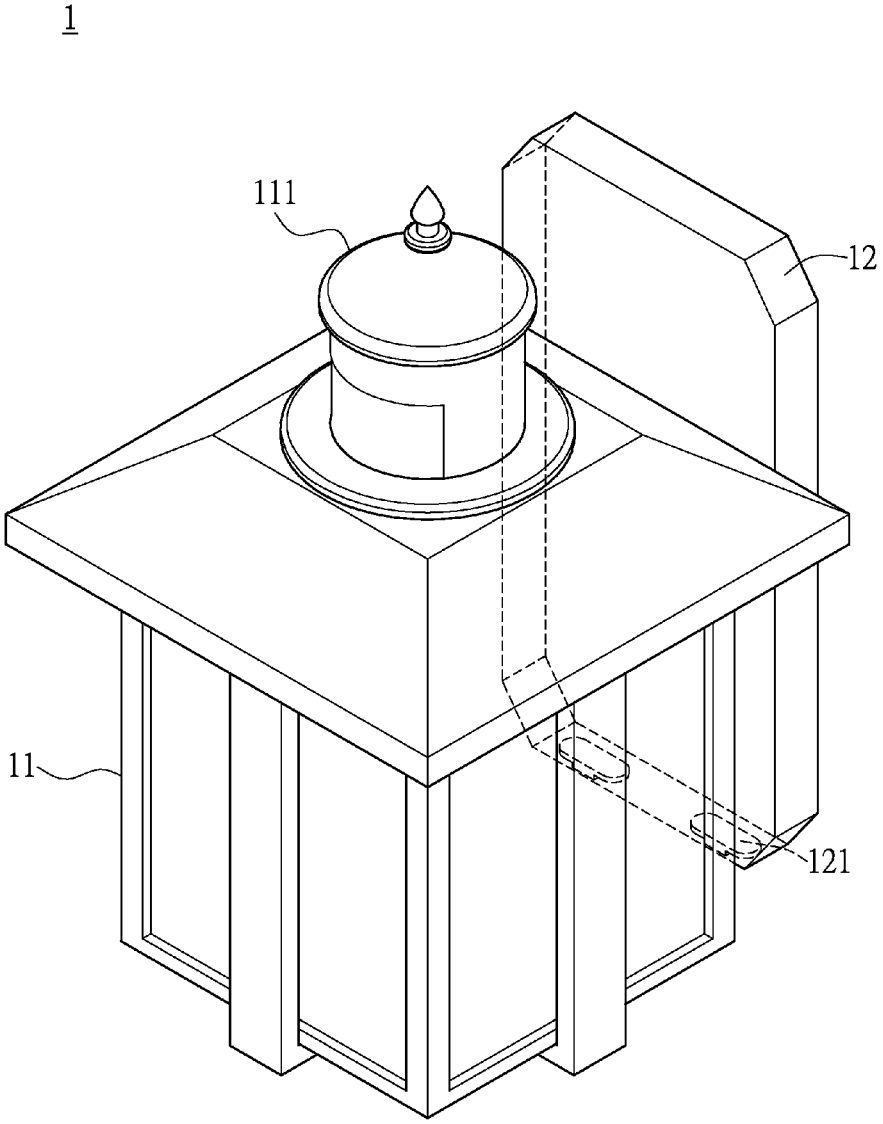
FIG.1A PRIOR ART
FIG. 1A shows a schematic diagram of a conventional sensing wall lamp.
Figure 1B:
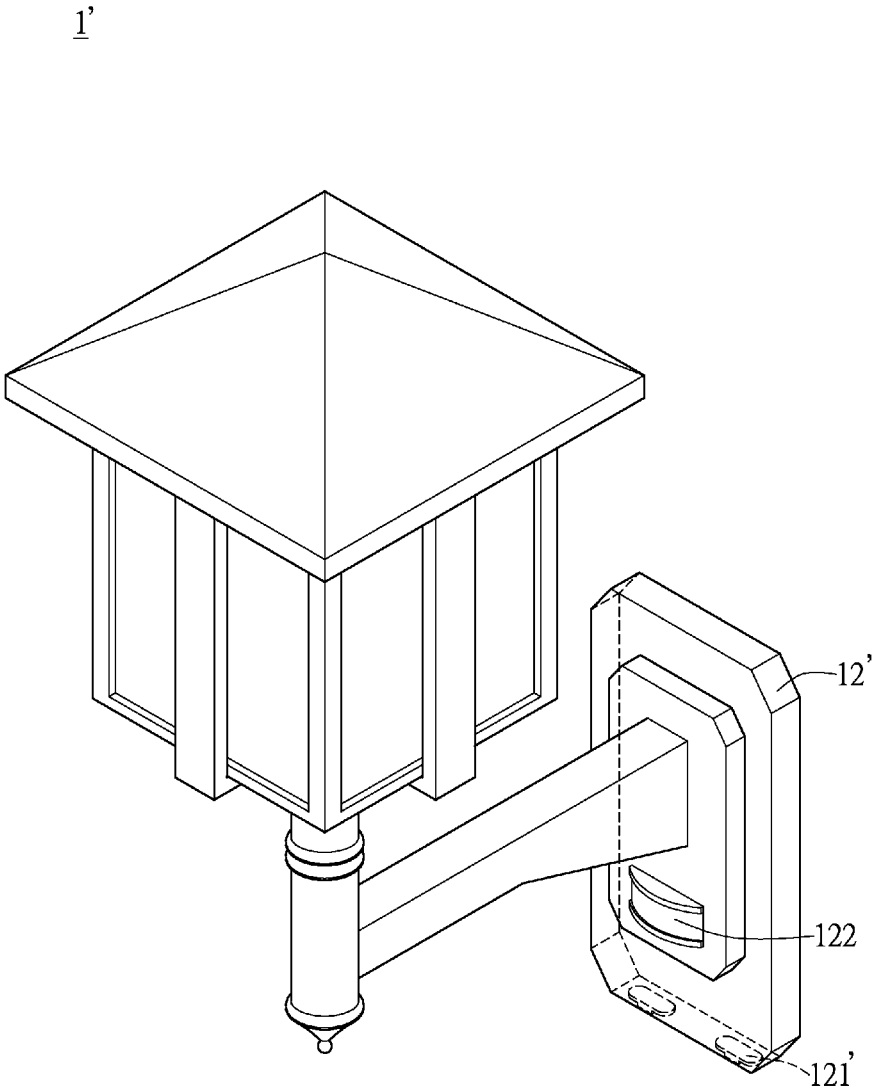
FIG.1B PRIOR ART
FIG. 1B shows a schematic diagram of a conventional sensing wall lamp.
Figure 2:
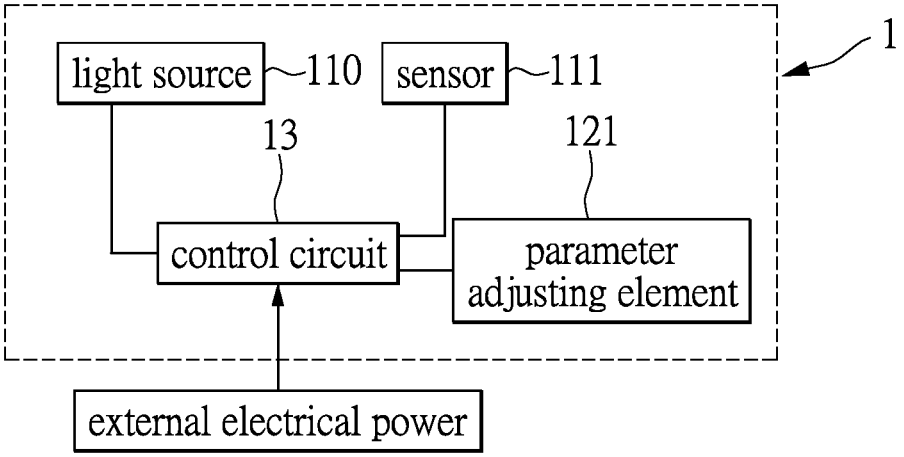
FIG.2 PRIOR ART
FIG. 2 shows a block diagram of a conventional sensing wall lamp.

Please refer to FIG. 5 showing a back view drawing of a sensing lamp according to an embodiment of the present disclosure. The sensing lamp 2 provides a user friendly way for adjustment and a more concise and aesthetic appearance (the parameter adjusting element is concealed). For example, the back plate 211 of the sensing lamp 2 can lead out the power wires 23 of the light source and the power wires 24 of the sensing module 22, and as such the wiring is simple. It only requires connecting these wires from the back plate to the exterior electrical power source or driving circuit. Therefore, by reducing the elements and the complexity of the wiring, the related cost of production of the lamp product and the probability of defects resulting during production process can be decreased. The back plate 211 is not required to be designed for cooperating with the wiring of the power wires, control wires, switches, or adjusting elements. As such, the design of the back plate can be more flexible. Basically, the back plate 211 can be designed according to the structure requirements without considering the sensing module 22. The complex design of the back plate 12 of the wall lamp 1 shown in FIG. 1 can be avoided. Further, in the subsequent embodiments, a sensing lamp without the back plate can also lead the power wires out of the light source and the sensing module, for achieving simplicity of the wiring.

Figure 3:
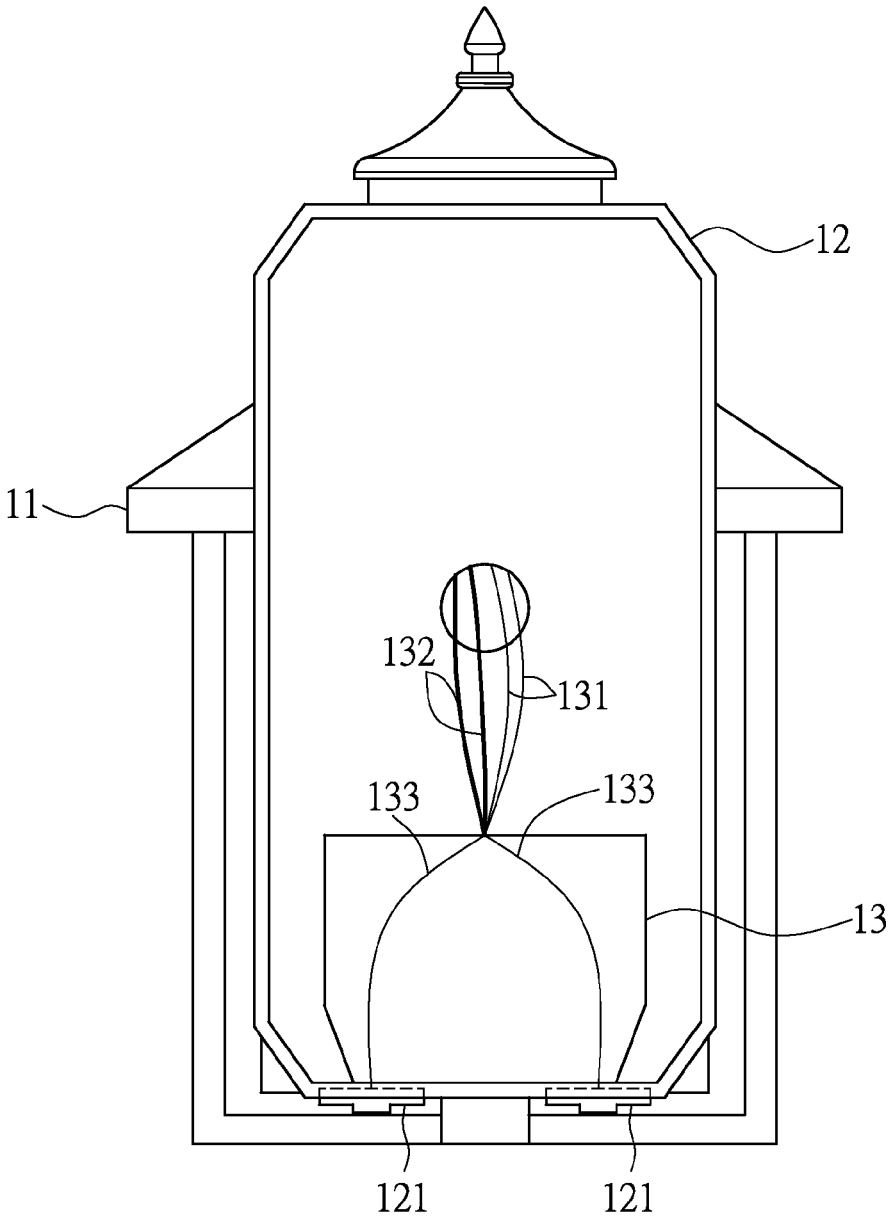
FIG.3 PRIOR ART
FIG. 3 shows a back view drawing of a conventional sensing wall lamp.

Please refer to FIG. 4 again. The sensing module 22 connects with the light body 21. As shown in FIG. 4, the sensing module 22 is disposed on the light body 21. However, in another embodiment, the sensing module 22 can be changed to connect with the bottom of the light body 21 or another position of the light body 21. Alternatively, the sensing module 22 can be disposed on the back plate (referred to subsequent embodiments). The location of the sensing module 22 can be changed according to practical applications (for example, the road lamp, the chandelier or the ceiling lamp), for the purpose of making the sensing module 22 be able to obtain the required sensing range, wherein the sensing range is determined in the design phase of the sensing light. In FIG. 4, the sensing module 22 comprises a sensing unit 221 and a cover 222. The sensing unit 221 has a sensor 2211, a control circuit 2212 and at least one parameter adjusting element 2213. The sensor 2211 and the parameter adjusting element 2213 are electrically coupled to the control circuit 2212. The control circuit 2212 of the sensing unit 221 is connected to an exterior electrical power source or a driving circuit (not shown in FIG. 4). The sensing unit 221 integrated with the conventional control circuit (referring to the control circuit 13 shown in FIG. 3) can be made on a single circuit board, in order to simplify the complexity of the circuit (or wiring). The sensing unit 221 shown in FIG. 4 is just an exemplary embodiment in order to describe the present disclosure in an understandable and clear way, but the structure of the sensing unit 221 is not so restricted.

A first side of the sensing unit 221 is provided with the sensor 2211. A second side of the sensing unit 221 is provided with the parameter adjusting element 2213. The sensing unit 221 can be an infrared sensing unit, a microwave sensing unit, a light sensing unit, or any combination thereof. However, this present disclosure does not limit the type of the sensing unit 221. The parameter adjusting element 2213 can be a slide switch, a knob . . . and so on, this present disclosure does not limit the type of the parameter adjusting element 2213. As shown in FIG. 4, in normal operation, the first side of the sensing unit 221 corresponds to the front side of the sensing lamp which is towards the +X direction. The second side of the sensing unit 221 corresponds to the back side of the sensing light which is towards the −X direction. However, the relative positions between the first side and the second can be changed according to the practical requirement of the design, and this shouldn't be a limitation to the present disclosure.

Figure 6:
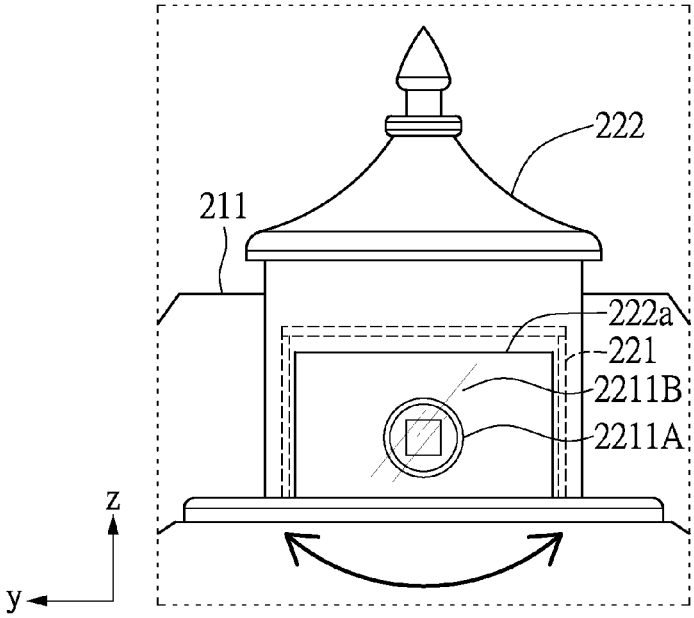
FIG. 6 shows a schematic diagram of a sensing lamp in normal status according to an embodiment of the present disclosure.
Figure 8:
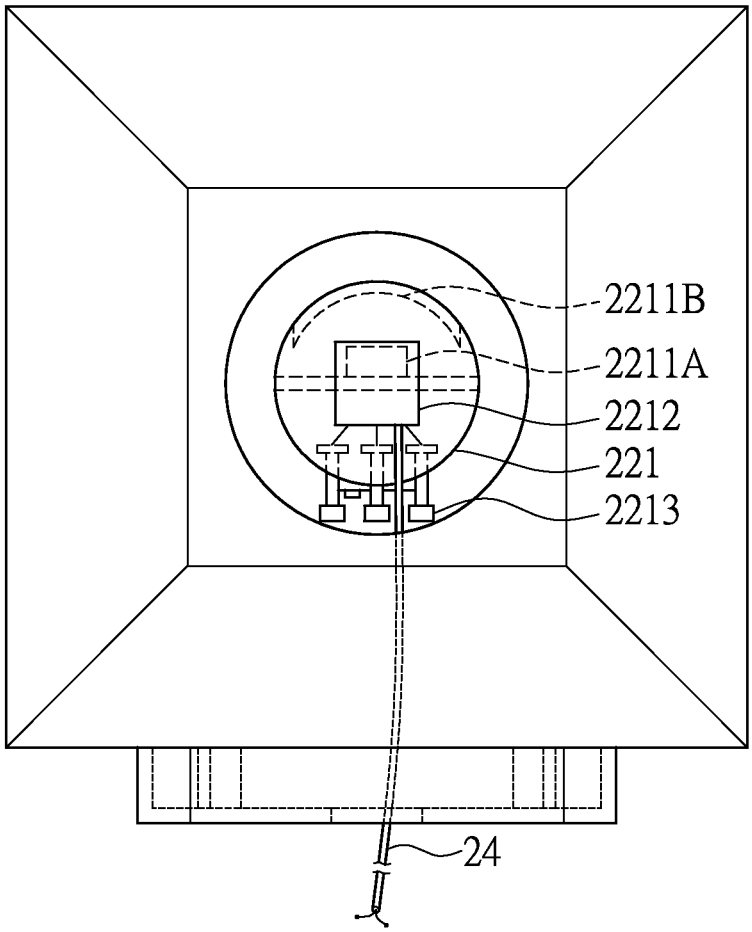
FIG. 8 shows a top view drawing of a sensing lamp according to an embodiment of the present disclosure.

Please refer to FIG. 6 in conjunction with FIG. 8. FIG. 6 shows a schematic diagram of a sensing lamp in normal status according to an embodiment of the present disclosure, and FIG. 8 shows a top view drawing of a sensing lamp according to an embodiment of the present disclosure. In FIG. 8, the cover 222 is removed, for ease of explanation and indication of the sensing unit 221. The control circuit 2212 is disposed in the sensing unit 221. The cover 222 partially covers the sensing unit 221. The cover 222 is combined with the light body 21 for partially covering the sensing unit 221. In this embodiment, an infrared sensing unit or a light sensing unit is taken as the example of the sensing unit 221, but the present disclosure is not so restricted. The sensor 2211 comprises at least one sensing element and a lens. For example, the sensor 2211 comprises at least one sensing element 2211A and a lens 2211B. The sensing element 2211A is electrically coupled to the control circuit 2212. The lens 2211B is disposed in front of the sensing element 2211A. The lens 2211B and the sensing element 2211A can be an integral structure. The material and the shape of the lens 2211B is not limited, and can be determined based on the type of the sensor. When the sensing unit 221 is an infrared sensing unit, the sensing element 2211A is an infrared sensing element, and the lens 2211B is an infrared lens. When the sensing unit 221 is a light sensing unit, the sensing element 2211A is a light sensing element, and the lens 2211B is a normal optical lens. In another embodiment, when the sensing unit 221 is a microwave sensing unit, the sensor 2211 is replaced by a microwave sensor comprising at least one microwave antenna, and the antenna is electrically coupled to the control circuit 2212, wherein the microwave sensor receives the microwave reflected by people (or object).

Corresponding to the sensor 2211, the cover 222 has an opening portion 222*a*. When the sensing unit 221 is rotated to a first angle, the sensor 2211 (especially the sensing element 2211A) corresponds to the opening portion 222*a* of the cover 222. In other words, the sensing element 2211A is behind the lens 2211B (when the sensing unit 221 is rotated to the first angle in normal operation). In normal operation, the sensing element 2211A receives sensing signals such as the exterior light, infrared or microwave reflections through the lens 2211B. The type of received sensing signal depends on the type of the sensor 2211 (or the sensing unit 221). At this time, the parameter adjusting element 2213 is at the back of the sensing unit 221.

Specifically, the sensing unit 221 and the light body 21 are rotatably connected. For example, the sensing unit 221 is connected to a rotation axis (and the rotation axis is connected to the light body), or the sensing unit 221 can be disposed on a rail on the light body 21. As such, the sensing unit 221 can rotate relative to the light body 21. In practical applications, a rotation angle limit is set to limit the sensing unit 221 rotating relative to the light body 21, in order to avoid breaking the power wires (such as the power wires 24 shown in FIG. 5) connecting the sensing unit 221 and the exterior electrical power source due to twisting the power wires when the rotation angle is too large.

As shown in FIG. 4, the sensing unit 221 can rotate about the Z axis, and the sensing unit 221 can rotate to a first angle and a second angle. However, this present disclosure does not limit the central axis which the sensing unit 221 rotates about to be the Z axis. The central axis about rotation can be changed to other directions. In this embodiment, the first angle corresponds to a normal operation status. As shown in FIG. 4, the Z axis is taken as the rotation central axis, and the first angle is towards the positive direction of the X axis (+X), such that the sensing unit 221 can sense signals such as the exterior light, infrared or microwave reflections through the lens 2211B. In one embodiment, for outdoor applications, when the sensing unit 221 is rotated to the first angle, the sensor 2211 and the cover 222 can further form an enclosed space to cover the control circuit 2212 and the parameter adjusting element 2213. Therefore, waterproof and dustproof efficacy can be achieved.

Figure 7:
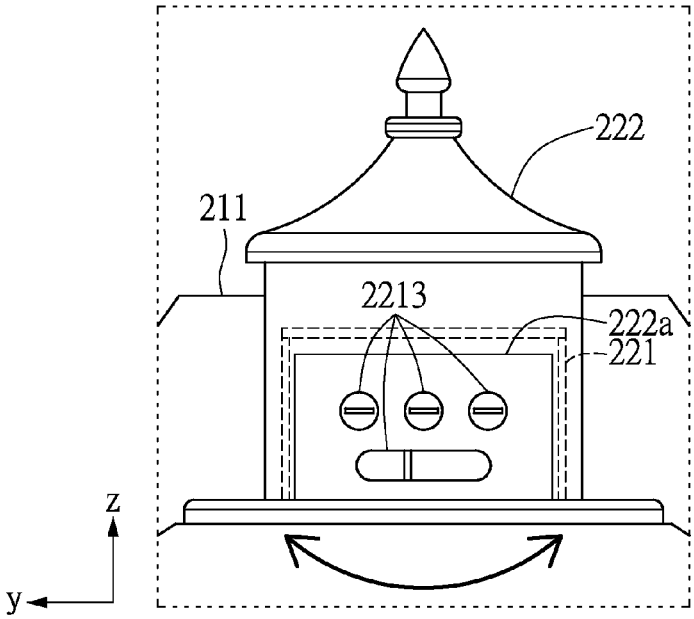
FIG. 7 shows a schematic diagram of a sensing lamp in adjustment status according to an embodiment of the present disclosure.

Please refer to FIG. 7 showing a schematic diagram of a sensing lamp in adjustment status according to an embodiment of the present disclosure. The second angle corresponds to an adjustment status. Consider the Z axis shown in FIG. 4 as the rotation central axis, and the second angle towards the negative direction of X axis (−X). When the sensing unit 221 is rotated to the second angle (towards −X), at least one parameter adjusting element 2213 is exposed, for the convenience of the user to manually adjust the parameter adjusting element 2213. At this time, because the sensing unit 221 is rotated to the second angle, the sensor 2211 (comprising the lens 2211B and the sensing element 2211A) is covered by the cover 222. In FIG. 7, as an exemplary embodiment, the shown parameter adjusting elements 2213 are three knobs and a slide switch.

In other words, when the sensing unit is rotated to the first angle (+X) which is for the normal operation status, the sensor 2211 at the first side of the sensing unit 221 is not covered by the cover 222. When the sensing unit 221 is rotated to the second angle (−X), the parameter adjusting element 2213 at the second side of the sensing unit 221 is not covered by the cover 222.

In practical applications, the first side can be the front-side (positive direction of the X axis shown in FIG. 4), the second side can be the back-side (negative direction of the X axis shown in FIG. 4), that is the sensor 2211 and the parameter adjusting element 2213 are respectively provided to the front-side and the back-side of the sensing unit 221. In the embodiment shown in FIG. 4, the difference between the first angle and the second angle can be 180 degrees, but the present disclosure is not so restricted. In another embodiment, the first side and the second side can be other than the front-side and the back-side respectively. Based on the design requirement, the angle difference between the first side and the second can be less than 180 degrees, for example the difference between the first angle and the second angle can be at least 90 degrees. That is, the difference between the first angle and the second angle can be varied or altered according to the practical requirement of the design. For example, the difference between the first angle and the second angle can be adjusted to an angle between 90 degrees and 180 degrees according to the practical requirement of the design. Alternatively, the difference between the first angle and the second angle can be less than 90 degrees.

Another Embodiment of the Sensing Lamp

Figure 9:
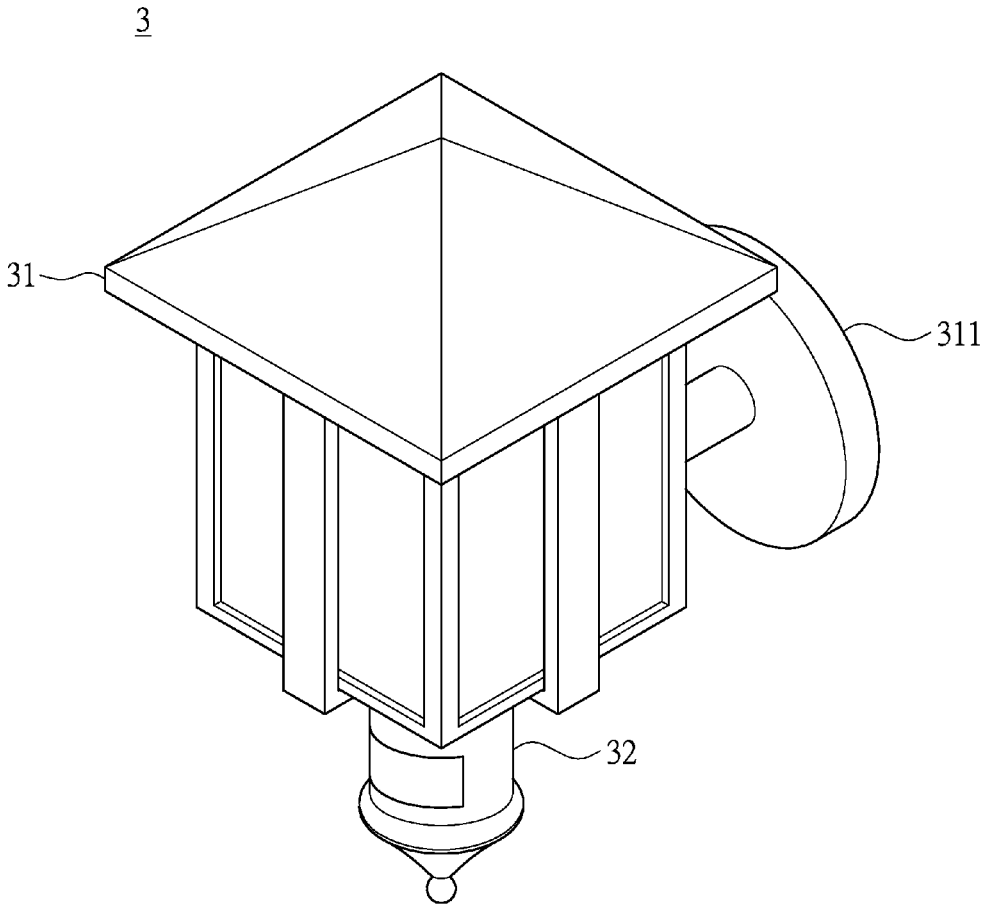
FIG. 9 shows a schematic diagram of a sensing lamp according to another embodiment of the present disclosure.

Please refer to FIG. 9 showing a schematic diagram of a sensing lamp according to another embodiment of the present disclosure. Compared to the embodiment shown in FIG. 4, the sensing module 32 of the sensing lamp 3 is changed to be connected to the bottom of the light body 31. Other components of the sensing lamp 3 are similar to the sensing lamp 2 shown in FIG. 4. For example, the difference between the back plate 311 and the back plate 211 shown in FIG. 4 is only that the shape of the back plate is different, that is to say that the back plate of the sensing lamp 3 can be arbitrarily changed according to practical applications. The sensing module 32 can comprise an infrared sensing unit, a microwave sensing unit, a light sensing unit, or any combination thereof, but the present disclosure is not so restricted. The sensing module 32 of the sensing lamp 3 is regarded as placing the sensing module 22 of FIG. 4 upside down, and the structure and the circuit function of the sensing module 32 are identical to those of the sensing module 22, thus the redundant information is not repeated.

Another Embodiment of the Sensing Lamp

Figure 10:
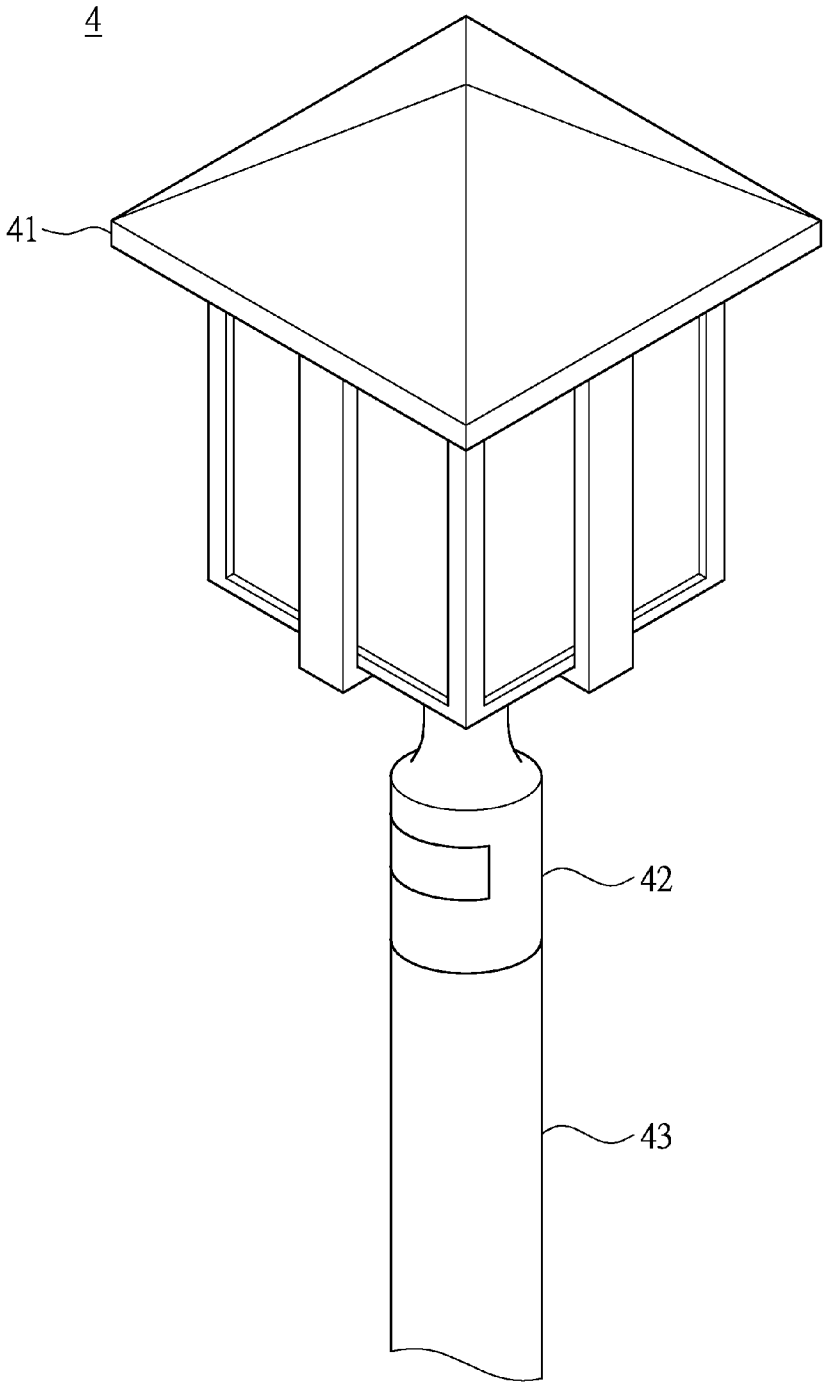
FIG. 10 shows a schematic diagram of a sensing lamp according to another embodiment of the present disclosure.

Please refer to FIG. 10 showing a schematic diagram of a sensing lamp according to another embodiment of the present disclosure. Compared to the embodiment shown in FIG. 9, the sensing module 42 of the sensing lamp 4 is also arranged at the bottom of the light body 41. However, compared to the sensing lamp 3 shown in FIG. 9, the sensing lamp 4 in FIG. 10 is a roadside lamp 4. Thus, the back plate is removed, and a supporting pole 43 is added. Other components of the sensing lamp 4 are similar to those of the sensing lamp 2 shown in FIG. 4. The sensing module 42 can comprise an infrared sensing unit, a microwave sensing unit, a light sensing unit, or any combination thereof, but the present disclosure is not so restricted. The sensing module 42 of the sensing lamp 4 is regarded as placing the sensing module 22 of FIG. 4 at a proper position, and the structure and the circuit function of the sensing module 42 are identical to those of the sensing module 22, thus the redundant information is not repeated. In another one embodiment, when the type of application of the sensing lamp 4 is changed, for example a chandelier, ceiling lamp or other lamp, the position and the detecting direction (angle or range) of the sensing module can be changed according to the requirement. In short, the present disclosure does not limit the type of the sensing module, the appearance of the sensing module and the position of the sensing module. Also, the present disclosure does not limit the sensing angle or range of the sensing module.

Another Embodiment of the Sensing Lamp

Figure 11:
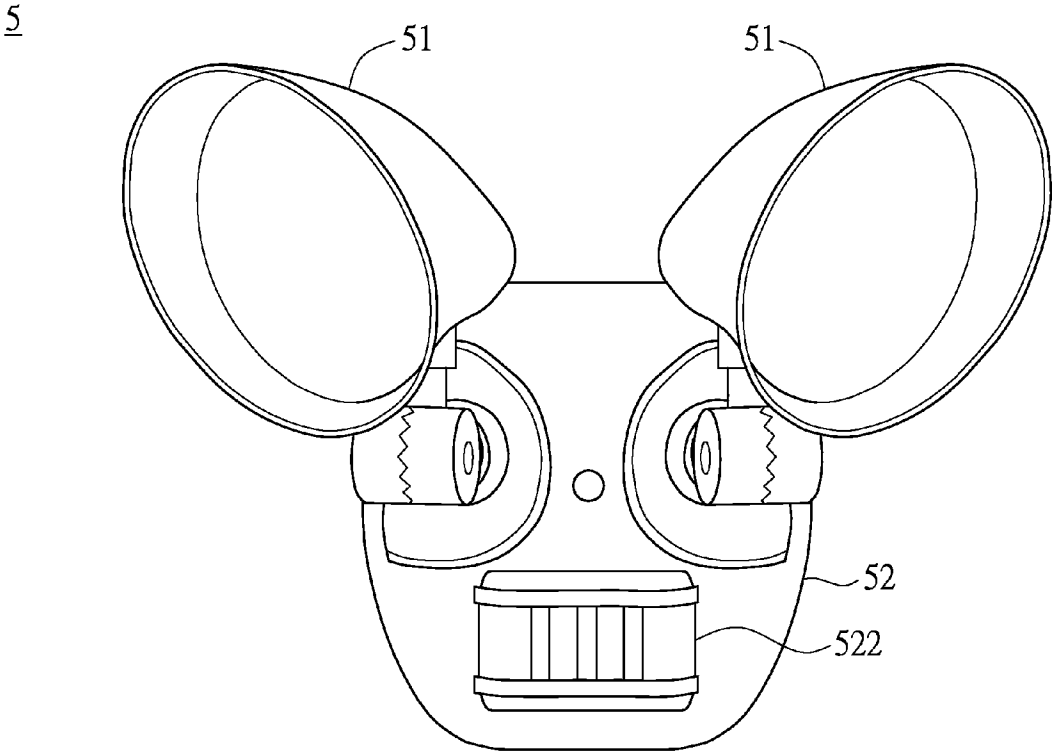
FIG. 11 shows a schematic diagram of a sensing lamp according to another embodiment of the present disclosure.

Please refer to FIG. 11 showing a schematic diagram of a sensing lamp according to another embodiment of the present disclosure. The sensing module 522 is not disposed on the light body 51, but on the back plate 52. In other words, the major difference between the sensing lamp 5 and the previous embodiments is the sensing module 522 is disposed on the back plate 52. The sensing unit (not shown in FIG. 11, referring to the sensing unit 221 shown in FIG. 4) of the sensing module 522 rotatably connects to the back plate 52. Additionally, the sensing lamp 5 shown in FIG. 11 comprises two light bodies 51, but the appearance of the sensing lamp 5 is not for restricting the scope of the present disclosure. The sensing module 522 can comprise an infrared sensing unit, a microwave sensing unit, a light sensing unit, or any combination thereof, but the present disclosure is not so restricted. The design concept of the sensing module 522 is identical to that of the sensing module 22, that is to say the design concept of the parameter adjusting element of the sensing module 522 is identical to the parameter adjusting element 2213 of the previous embodiment, thus the redundant information is not repeated.

According to above descriptions, the provided sensing lamp integrates the sensor and the control circuit into the sensing module. As such, the wiring layout is simple, the arrangement of control wires or power wires is simplified, and the related cost of production of the lamp product and the probability of defects resulting during production process can be reduced. The sensing lamp is provided with user friendly way for adjustment and more concise and aesthetic appearance (the parameter adjusting element is concealed). By utilizing the rotatable sensing unit of the sensing lamp, the user can easily rotate the sensing unit to an angle (the second angle) adapted for operating the parameter adjusting element(s), so as to adjust the related parameter of the sensing unit. After the adjustment is finished, the sensing unit can return to the normal operation angle (first angle). Because the back plate of the sensing lamp is not restricted to incorporate the parameter adjusting element(s), the design flexibility is significantly increased when considering the back plate to match the aesthetic appearance of the overall light body.

The descriptions illustrated supra set forth simply the preferred embodiments of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A sensing lamp, comprising:

a light body, having a light source; and a sensing module, connecting the light body, the sensing module comprising:

a sensing unit, having at least one sensor, a control circuit and at least one parameter adjusting element, the sensor and the parameter adjusting element electrically coupled to the control circuit, wherein a first side of the sensing unit is provided with the sensor, a second side of the sensing unit is provided with the parameter adjusting element, the control circuit disposed in the sensing unit; and a cover, partially covering the sensing unit;

wherein the sensing unit and the light body are rotatably connected, the sensing unit is capable of rotating to a first angle and a second angle, the sensor at the first side of the sensing unit is not covered by the cover when the sensing unit is rotated to the first angle, the parameter adjusting element at the second side of the sensing unit is not covered by the cover when the sensing unit is rotated to the second angle.

2. The sensing lamp according to claim 1, wherein the sensing unit is an infrared sensing unit.

3. The sensing lamp according to claim 2, wherein the sensor comprises at least one infrared sensing element and a lens, the infrared sensing element is electrically coupled to the control circuit, the lens is disposed in front of the infrared sensing element.

4. The sensing lamp according to claim 1, wherein the sensing unit is a microwave sensing unit.

5. The sensing lamp according to claim 4, wherein the sensing unit comprises at least one antenna, the antenna is electrically coupled to the control circuit.

6. The sensing lamp according to claim 1, wherein the sensing unit is a light sensing unit.

7. The sensing lamp according to claim 6, wherein the sensor comprises at least one light sensing element and a lens, the light sensing unit is electrically coupled to the control circuit, the lens is disposed in front of the light sensing element.

8. The sensing lamp according to claim 1, wherein the sensing lamp is a wall lamp, a roadside lamp, a chandelier or a ceiling lamp.

9. The sensing lamp according to claim 1, wherein when the sensing unit is rotated to the first angle, the sensor and the cover form an enclosed space to cover the control circuit and the parameter adjusting element.

10. The sensing lamp according to claim 1, wherein the cover has an opening portion, the sensor corresponds to the opening portion of the cover when the sensing unit is rotated to the first angle.

11. The sensing lamp according to claim 1, wherein the cover has an opening portion, the parameter adjusting element corresponds to the opening portion of the cover when the sensing unit is rotated to the second angle.

12. The sensing lamp according to claim 1, wherein the difference between the first angle and the second angle is less than 180 degrees.

13. The sensing lamp according to claim 1, wherein the difference between the first angle and the second angle is 180 degrees.

14. The sensing lamp according to claim 1, wherein the control circuit of the sensing unit is connected to an exterior electrical power source or a driving circuit.

15. A sensing lamp, comprising:

a light body, having a light source;

a back plate, connecting the light body; and a sensing module, disposed on the back plate, the sensing module comprising:

a sensing unit, having at least one sensor, a control circuit and at least one parameter adjusting element, the sensor and the parameter adjusting element electrically coupled to the control circuit, wherein a first side of the sensing unit is provided with the sensor, a second side of the sensing unit is provided with the parameter adjusting element, the control circuit disposed in the sensing unit; and a cover, partially covering the sensing unit;

wherein the sensing unit and the back plate are rotatably connected, the sensing unit is capable of rotating to a first angle and a second angle, the sensor at the first side of the sensing unit is not covered by the cover when the sensing unit is rotated to the first angle, the parameter adjusting element at the second side of the sensing unit is not covered by the cover when the sensing unit is rotated to the second angle.

16. The sensing lamp according to claim 15, wherein the sensing unit is an infrared sensing unit.

17. The sensing lamp according to claim 15, wherein the sensing unit is a microwave sensing unit.

18. The sensing lamp according to claim 15, wherein the sensing unit is a light sensing unit.

19. The sensing lamp according to claim 15, wherein the cover has an opening portion, the sensor corresponds to the opening portion of the cover when the sensing unit is rotated to the first angle.

20. The sensing lamp according to claim 15, wherein the cover has an opening portion, the parameter adjusting element corresponds to the opening portion of the cover when the sensing unit is rotated to the second angle.

* * * * *